United States Patent [19]

Neumann

[11] 4,273,437

[45] Jun. 16, 1981

[54] BEARING PLATE FOR A BAND OF PHOTOCONDUCTIVE RECORDING MEDIUM

[75] Inventor: Jürgen Neumann, Liederbach, Fed. Rep. of Germany

[73] Assignee: Hoechst Aktiengesellschaft, Frankfurt am Main, Fed. Rep. of Germany

[21] Appl. No.: 60,224

[22] Filed: Jul. 24, 1979

[30] Foreign Application Priority Data

Jul. 26, 1978 [DE] Fed. Rep. of Germany ..... 2832775

[51] Int. Cl.[3] ..... G03G 15/00

[52] U.S. Cl. ..... 355/3 BE; 355/16

[58] Field of Search ..... 355/3 R, 3 BE, 3 SC, 355/16

[56] References Cited

U.S. PATENT DOCUMENTS

| | | | |
|---|---|---|---|
| 3,480,364 | 11/1969 | Barnett | 355/3 R X |
| 3,533,692 | 10/1970 | Blanchette et al. | 355/16 |
| 3,912,390 | 10/1975 | Van Herten | 355/16 X |
| 3,914,047 | 10/1975 | Hunt et al. | 355/16 |
| 4,059,353 | 11/1977 | Shaffer | 355/16 |

FOREIGN PATENT DOCUMENTS 2220909 6/1978 Fed. Rep. of Germany .

OTHER PUBLICATIONS

Grannis et al., "Grounding Scheme for Moving Photoconductor", IBM Technical Disclosure Bulletin, Nov. 1970, vol. 13, No. 2, p. 1660.

Jewett, William S., "Kodak Ektaprint Copier-Duplicator", IEEE Industry Applications Society Annual Meeting, Oct. 1977 pp. 557-568.

*Primary Examiner*—Fred L. Braun

*Attorney, Agent, or Firm*—Schwartz, Jeffery, Schwaab, Mack, Blumenthal & Koch

[57] ABSTRACT

A bearing plate for a moving band of photo-conductive recording medium, wherein the band is provided with perforations close to and parallel to one of its two longitudinal edges and is adapted to be contacted by a metal brush pressing against the recording medium in the zone of the perforated longitudinal edge. The bearing plate is formed from a base plate of a conductive material having an aperture therethrough and an electrically conductive grid covering the aperture.

10 Claims, 2 Drawing Figures

BEARING PLATE FOR A BAND OF PHOTOCONDUCTIVE RECORDING MEDIUM

BACKGROUND OF THE INVENTION

The present invention relates to a bearing plate for a band of photoconductive recording medium which travels around in an endless loop and is provided with perforations close to and parallel to one of the two longitudinal edges, and in which a metal brush presses against the recording medium in the zone of the perforated longitudinal edge.

In electrophotographic copying devices, bands of photoconductive recording media are used, such as, for example, organic photoconductor bands in the form of endless belts. The timing sequence and the mutual synchronization of the individual process steps are effected by means of electric contacts. For this purpose, the use of an organic photoconductor which has a number of holes along its front edge has been disclosed in the papers read at the annual meeting of IEEE Industry Applications Society in October 1977. These are standard perforations, such as are conventionally used in 35 mm films. These perforations represent a means for generating time signals which are related to the motion of the band. This known organic photoconductor consists of a photoconductive layer, an electrically conductive layer lying below it, and a support layer. In addition to the perforations of usual length, there are also six perforations of double the length. These six perforations of double length emit signals to the microprocessor system of the electrophotographic copying machine in which the photoconductor band is used, these signals triggering inter alia the flash exposures of six imaging elements along the length of the photoconductor tape. Between every pair of perforations of double length, there are fifty standard perforations, and the signals triggered by these perforations are utilized for controlling the timing sequence of the remaining process steps.

The electrical connection of the support layer of the photoconductor band is made by a wire brush which is in contact with a strip applied along the edge of the photoconductor band.

The time signals are generated by means of a twin sensor. The latter is actuated by a hammer which presses against the photoconductor band along the perforations under a slight pressure. When a perforation passes through under the hammer, the latter strikes the bearing plate on which piezo-electric strips are fitted. The strips of a piezo-electric ceramic material are polarized in mutually opposite directions in order to generate an electric signal of corresponding magnitude on each actuation of the hammer, and they are components of the hammer arrangement. The hammer exerts very small forces on the photoconductor band so that there is no destruction. The generation of signals is stable over a very large number of actuations of the hammer and is not prone to soiling and environmental influences. It can be seen, however, that the use of piezo-electric ceramic strips necessitates a downstream amplifier or a high-resistance and hence fault-prone line, and as a result of which, the manufacturing costs also rise.

A process for the sectional operation of a band of photoconductive recording medium in an electrophotographic copying machine is known from German Auslegeschrift No. 2,220,909. There the passage or the motion of the recording medium is controlled by means of markings formed in or on the recording medium, which markings are identified by a reader device and are converted into data which control the forward motion. In this case, the markings are formed only during the passage of the tape-like recording medium in the copying machine itself, for each desired size of format and exactly at the correct point.

A tape-like recording medium which, for controlling the forward motion, has markings which can be electrically conductive markings, perforations or the like, and which are made on the recording medium before it is installed, is known from German Auslegeschrift No. 1,263,509.

If a band of photoconductive recording medium with holes or perforations is used, in connection with which contact brushes of metal slide at the level of the holes on the surface of the photoconductor, and the photoconductor moves along the surface of a grounded metal plate, a contact is made as the result of the metal contact brush touching the metal plate at the points of the perforations. The contact arises with low resistance and can be directly further used electrically, without a high-resistance line or an amplification being necessary. In this case, however, faults can occur on prolonged copying operation due to soiling with toner, caused by the fact that toner gets into the holes and is transported with the photoconductor band and deposits on the metal plate and on the contact brushes. The result of this is a break of the electric contact between the contact brushes and the metal plate.

SUMMARY OF THE INVENTION

It is therefore an object of the invention to provide an improved bearing plate for a band of photoconductive recording medium.

It is a particular object of the invention to provide an improved bearing plate, of the type described at the outset, for a band of photoconductive recording medium in such a way as to avoid breaks of the electric contact between the bearing plate and the metal brush in the zone of the perforations of the recording medium due to soiling of the recording medium with toner and due to deposits of toner in the perforations.

It is also an object of the invention to provide an improved photocopy apparatus embodying the improved bearing plate as part of a control assembly.

In accomplishing the foregoing objects, there has been provided in accordance with the present invention a bearing plate for a moving band of photo-conductive recording medium, wherein the band is provided with perforations close to and parallel to one of its two longitudinal edges and is adapted to be contacted by a metal brush pressing against the recording medium in the zone of the perforated longitudinal edge, the bearing plate comprising a base plate of a conductive material having at least one aperture therethrough and an electrically conductive grid covering the aperture. Preferably, the aperture comprises at least one shoulder and the grid rests on said shoulder, most preferably so that the top of the grid ends flush and is aligned with the bearing surface of the bearing base plate. In the most preferred embodiment the grid comprises a grid of wire mesh, preferably wherein the mesh width of the grid is up to about 2.0 mm.

In accordance with another aspect of the present invention, there has been provided, in a photocopy apparatus including a moving band of photo-conductive medium having perforations of predetermined spacing arranged adjacent to and parallel with one longitudinal edge, a control assembly comprising a bearing plate for supporting the moving band on a supporting surface thereof, and a metal brush mounted opposite the supporting surface in such a way as to press against the moving band being supported thereon in the region of the perforations. The bearing plate comprises an electrically conductive base plate having at least one aperture therethrough opposite the brush and an electrically conductive grid structure covering the aperture. Preferably, the assembly includes means for grounding the bearing plate and means including a relay and a voltage source for connecting the bearing plate to the metal brush.

Further objects, features and advantages of the invention will become apparent from the detailed description of preferred embodiments which follows, when considered together with the accompanying figures of drawing.

DETAILED DESCRIPTION OF PREFERRED EMBODIMENTS

According to the invention, at least one passage, which is covered by an electrically conductive grid, is present in the bearing plate. Obviously, not just one passage but rather several pasages with a corresponding number of metal brushes in the zone of each passage can be provided.

In one embodiment of the invention, each passage has at least one shoulder and the grid rests on this shoulder. Appropriately, the top of the grid ends flush and is aligned with the bearing surface of the bearing plate; this ensures that the photoconductor band can be moved smoothly over the bearing plate. Preferably, the grid is a grid of wire mesh, the mesh width of which is up to about 2 mm. In particular, the mesh width of the grid can be about 1 mm.

The design of the invention is such that the longitudinal dimension of a perforation is smaller than the longitudinal dimension of the shoulder and greater than the diameter of the passage. The bearing plate is grounded and connected via a relay to the metal brush. As soon as contact is made between the metal brush and the bearing plate, the relay is actuated so that it emits a corresponding control pulse for the exact control of the forward motion of the photoconductor band.

The invention has the advantage that good electric contact between the metal brush and the bearing plate is made at all times, since the toner dust which arises is automatically removed through the grid of wire mesh, without the possibility of sticking on the contact surface of the bearing plate. The metal brush always cleans the contact point again.

Figure 1:
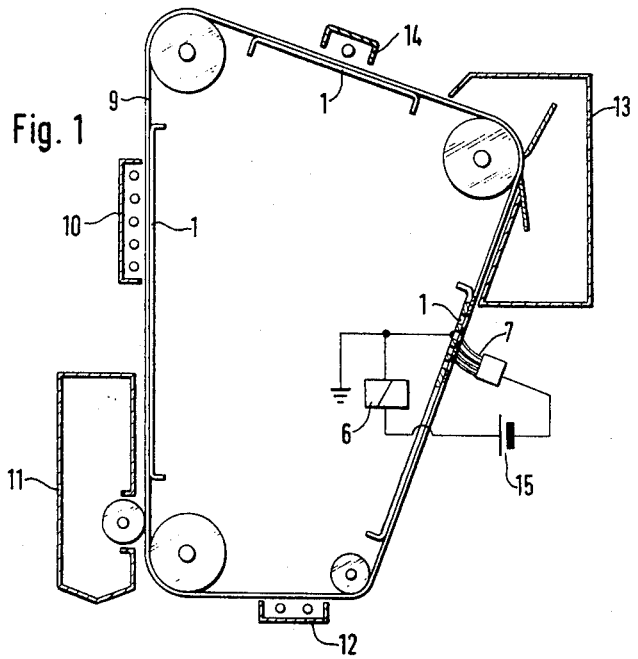
FIG. 1 is a diagrammatic view of the path of the photoconductive tape-like recording medium and of the individual electrophotographic processing stations.

FIG. 1 diagrammatically represents a band of photoconductive recording medium 9 which is joined together to give an endless belt and is guided over rollers. Various processing stations of the electrophotographic copying device are arranged along the recording medium, such as, for example, a charging corona 10, a developing station 11, a transfer corona 12, a cleaning station 13 and an eraser lamp 14. The recording medium 9 runs over bearing plates 1, one of which is grounded and is connected via a relay 6 and a voltage source 15 to a metal brush 7, the metal bristles of which press against the front of the recording medium.

Figure 2:
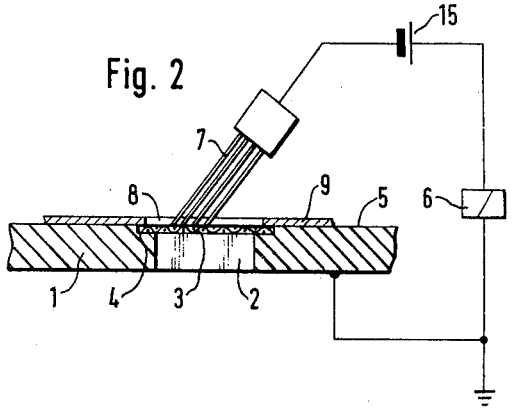
FIG. 2 is an enlarged view of a bearing plate according to the invention with a photoconductive recording medium passing over it.

As can be seen in the enlarged partial view according to FIG. 2, at least one passage 2 having a shoulder 4 is present in the bearing plate 1. It is also possible for several shoulders to be present, although this is not shown. The passage 2 is covered by an electrically conductive grid 3 which rests on the shoulder 4. This grid 3 preferably is a grid of wire mesh, which has a mesh width of up to about 2 mm. In particular, a mesh grid having a mesh width of about 1 mm is used. The grids employed can be conventional grids of wire mesh, which are obtainable very inexpensively.

The top of the grid 3 ends flush and is aligned with the bearing surface 5 of the bearing plate 1, which ensures that the recording tape 9 moves smoothly over the bearing plate 1. Toner material which is deposited on the bearing plate 1 through the perforations of the recording tape 9 passes through the grid 3 and the passage 2, for example a bore, so that there is no accumulation of toner on the bearing plate 1, which could cause a break in contact between the metal brush 7 and the bearing plate 1.

The individual perforation 8 is shaped in such a way that its longitudinal dimension is smaller than the longitudinal dimension of the shoulder 4 and greater than the diameter of the passage 2.

It is obvious that more than one metal brush 7, with an associated passage 2 in the bearing plate 1, can be present, with each of the metal brushes 7 being connected via one relay 6 in each case to the grounded bearing plate 1. It is not necessary here that all the metal brushes 7 are associated with the same bearing plate 1; rather, it is possible to allocate the metal brushes 7 to the individual bearing plates 1 along the path of the recording tape 9.

What is claimed is:

1. A bearing plate for a moving band of photoconductive recording medium, wherein the band is provided with perforations close to and parallel to one of its two longitudinal edges and is adapted to be contacted by a metal brush pressing against the recording medium in the zone of the perforated longitudinal edge, said bearing plate comprising a base plate of a conductive material having at least one aperture therethrough and an electrically conductive grid covering said aperture, said grid being positioned such that it is contacted by the metal brush through the perforations in the photoconductive recording medium.

2. A bearing plate as claimed in claim 1, wherein said aperture comprises at least one shoulder and wherein said grid rests on said shoulder.

3. A bearing plate as claimed in claim 2, wherein the top of the grid ends flush and is aligned with the surface of the bearing base plate.

4. A bearing plate as claimed in claim 2, wherein the longitudinal dimension of a perforation in the band of recording medium is smaller than the longitudinal dimension of the shoulder and greater than the diameter of said aperture.

5. A bearing plate as claimed in claim 1, wherein said grid comprises a grid of wire mesh.

6. A bearing plate as claimed in claim 5, wherein the mesh width of the grid is up to about 2.0 mm.

7. A bearing plate as claimed in claim 1, further comprising circuit means connected to said metal brush and said bearing plate for generating a control pulse upon contact of the metal brush and the conductive grid portion of the metal plate through the perforations in the band of photoconductive recording medium.

8. In a photocopy apparatus including a moving band of photoconductive medium having perforations of predetermined spacing arranged adjacent to and parallel with one longitudinal edge, a control assembly comprising a bearing plate for supporting the moving band on a supporting surface thereof, and a metal brush mounted opposite said supporting surface in such a way as to press against the moving band being supported thereon in the region of the perforations, said bearing plate comprising an electrically conductive base plate having at least one aperture therethrough opposite said brush and an electrically conductive grid structure covering the aperture.

9. A bearing plate for a moving band of photoconductive recording medium, wherein the band is provided with perforations close to and parallel to one of its two longitudinal edges and is adapted to be contacted by a metal brush pressing against the recording medium in the zone of the perforated longitudinal edge, said bearing plate comprising:

a base plate of a conductive material having at least one aperture therethrough;

an electrically conductive grid covering said aperture;

means for grounding the bearing plate; and means including a relay and a voltage source for connecting the bearing plate to the metal brush.

10. In a photocopy apparatus including a moving band of photoconductive medium having perforations of predetermined spacing arranged adjacent to and parallel with one longitudinal edge, a control assembly comprising:

a bearing plate for supporting the moving band on a supporting surface thereof;

a metal brush mounted opposite said supporting surface in such a way as to press against the moving band being supported thereon in the region of the perforations;

said bearing plate having an electrically conductive base plate containing at least one aperture therethrough opposite said metal brush;

an electrically conductive grid structure covering the aperture;

means for grounding said bearing plate; and means including a relay and a voltage source for connecting said bearing plate to said metal brush.

* * * * *